US007542906B2

(12) United States Patent
Duke et al.

(10) Patent No.: US 7,542,906 B2
(45) Date of Patent: Jun. 2, 2009

(54) OFF-SITE DETENTION MONITORING SYSTEM

(75) Inventors: Michael D. Duke, St. Petersburg, FL (US); Rainer J. Rothacker, Cliffwood Beach, NJ (US); Carol E. Webb, Shell Knob, MO (US)

(73) Assignee: T-Netix, Inc., Dallas, TX (US)

( * ) Notice: Subject to any disclaimer, the term of this patent is extended or adjusted under 35 U.S.C. 154(b) by 842 days.

(21) Appl. No.: 10/945,742

(22) Filed: Sep. 20, 2004

(65) Prior Publication Data

US 2005/0210268 A1 Sep. 22, 2005

(51) Int. Cl.
*G10L 21/00* (2006.01)

(52) U.S. Cl. ..... 704/270; 704/275

(58) Field of Classification Search ..... 704/270, 704/275; 340/304
See application file for complete search history.

(56) References Cited

U.S. PATENT DOCUMENTS

| | | | | |
|---|---|---|---|---|
| 4,843,377 | A | 6/1989 | Fuller et al. | |
| 4,999,613 | A | 3/1991 | Williamson et al. | |
| 5,146,207 | A | 9/1992 | Henry et al. | |
| 5,170,426 | A * | 12/1992 | D'Alessio et al. | 379/38 |
| 5,204,670 | A | 4/1993 | Stinton | |
| 5,206,897 | A | 4/1993 | Goudreau et al. | |
| 5,502,759 | A | 3/1996 | Cheng et al. | |
| 5,568,119 | A | 10/1996 | Schipper et al. | |
| 5,608,784 | A | 3/1997 | Miller | |
| 5,617,574 | A | 4/1997 | Boutaud et al. | |
| 5,666,400 | A | 9/1997 | McAllister et al. | |
| 6,054,928 | A | 4/2000 | Lemelson et al. | |
| 6,101,242 | A * | 8/2000 | McAllister et al. | 379/88.02 |
| 6,437,696 | B1 | 8/2002 | Lemelson et al. | |
| 6,463,127 | B1 | 10/2002 | Maier et al. | |

* cited by examiner

*Primary Examiner*—Michael N Opsasnick
(74) *Attorney, Agent, or Firm*—Slater & Matsil, L.L.P.

(57) ABSTRACT

The present invention provides an Internet based system and method for monitoring the location of a subject at any time via telephone voice verification. The system and method enables an agency officer to enroll a subject's profile into a computerized system. The subject then responds to a series of verbally answered questions, the responses to which are utilized to establish a voice signature for the subject. Subsequently, the system and method automatically and periodically contacts the subject at pre-determined locations at pre-determined times to verify the subject's actual presence at the locations via voice verification software. The present invention also enables the agency officer to monitor and review compliance efforts implemented by the Internet based system while also providing notifications of non-compliance by the subject to the agency officer under criteria previously established by the officer.

10 Claims, 10 Drawing Sheets

OFF-SITE DETENTION MONITORING SYSTEM

CROSS-REFERENCE TO RELATED APPLICATION

This application claims the benefit of Non-Provisional Patent Application No. 09/607,668, filed Jun. 30, 2000, which is incorporated by reference herein in its entirety, and which claims the benefit of U.S. Provisional Patent Application Ser. No. 60/142,165 filed Jul. 1,1999.

FIELD OF THE INVENTION

The present invention relates to case management systems commonly utilized to monitor the location and activities of specific individuals. More particularly, the present invention relates to voice verification monitoring systems which utilize pre-recorded voice prints and real-time responses from specific individuals to verify the location of individuals within designated time windows.

BACKGROUND OF THE INVENTION

With the rapid increase in crime in the last 20 years, prisons, jails, and the like have often become overcrowded, and a tremendous increase in the number of convicted felons and other offenders (hereafter, "Subjects") on parole or probation has occurred. As a result, correctional officers, facilities, and agencies have faced enormous difficulties in verifying and monitoring the compliance of Subjects with restrictions on their freedom of movement, such as house arrest, work release, and similar parole and probation measures (hereafter, "Restriction Programs").

One approach at verifying the compliance of Subjects with Restriction Programs has been to attach electrically sensitive collars to ankles. While this system verifies a Subject is located within a pre-determined range of a central monitoring station, it often fails to ensure a Subject is at designated locations which are beyond the range of the monitoring station (for example, work or school).

Another approach used to verify and monitor the compliance of Subjects with Restriction Programs utilizes automated voice verification systems, wherein a computer, telephone operator, or the like periodically calls a Subject and verifies the Subject is where they are supposed to be. While such systems, generally, can accurately verify that the speaker is actually the Subject, commonly, such systems have proven difficult to set-up, operate, use, and manage. Additionally, such systems commonly do not allow a probation officer, parole officer, or such to verify real-time whether a Subject actually responded to a location verification or, as Subjects commonly allege, whether the verification system malfunctioned.

Thus, a system capable of verifying that a Subject is complying with a Restriction Program is needed. Additionally, an efficient, effective, and easy to access and use system is needed which allows an Officer to verify previous responses by a Subject to queries and initiate verifications real-time.

SUMMARY OF THE INVENTION

The present invention provides an Internet based system and method for monitoring the location of a Subject at any time (and thus, the Subject's compliance with a Restriction Program) via voice verification over the telephone. The present invention provides Internet connectivity and functionality to all features of a voice verification and monitoring system.

More particularly, the present invention provides a system which allows a correctional agency, parole officer, or the like (hereafter, "Officer") to enroll a Subject at any time, via the Internet, into the voice verification and monitoring system of the present invention. Enrollment of a Subject into the system of the present invention suitably encompasses the entry of Subject specific data (for example, name, address, and phone numbers) and obtaining a voice print from a Subject. The voice print from the Subject is preferably obtained by having the Subject repeat at least one pre-determined password/pass phrase (hereafter, "Password"). In the preferred embodiment, four Passwords are obtained for each Subject.

Upon enrollment of a Subject, the present invention contacts a Subject at pre-determined locations within pre-determined time periods while also allowing random and real-time verifications of a Subject's location. The present invention verifies that a Subject is actually responding to the prompts generated by the present invention by comparing the voice response(s) of the Subject to requests to repeat previously recorded Passwords. The present invention also suitably stores all attempted (both successful and unsuccessful) contacts of a Subject in a database which an Officer may access at any time from any Internet location and thereby review each contact of a Subject by the present invention, including the Subject's actual response to queries.

The present invention also allows an Officer to leave messages for a Subject via the Internet which are relayed to a Subject at a designated time or upon the occurrence of a designated event, for example upon the verification of a Subject's presence at a specific location.

The present invention preferably randomly selects at least one Password recorded during enrollment of the Subject to verify a Subject's location. Random selection of the Password reduces the possibility of deception occurring from taped utterances or the like. Preferably the system distinguishes between live responses and even those previously digitally recorded. At the time of enrollment of a Subject, the present invention, preferably creates a plurality of voice prints of Passwords, any of which the present invention may randomly use. The present invention also may suitably select a single Password or a series of Passwords in verifying a Subject's location based upon pre-set criteria including the quality of the telecommunications connection, the accuracy of the voice matches, and the like.

Another feature of the present invention is the ability to alter the sensitivity of the speaker verification "engine" based on the Subject's gender, the time of day, and/or whether the Subject is a new user of the present invention. When the Subject is a new user, the present invention preferably reduces the sensitivity of the "engine" to allow the Subject time to become familiar and comfortable with the verification methods employed by the present invention. The present invention preferably adjusts the pass/fail thresholds for voice tests based upon the gender of the Subject. In particular, the invention raises the threshold for female voices over the normal threshold used for male voices. In this manner, the present invention preferably decreases the risk of imposters tricking the voice verification systems of the present invention.

The present invention accomplishes the aforementioned features by providing a computer server which allows access to the features and capabilities of the present invention via an Internet web site with connections provide by and/or suitably hosted on an Internet Service Provider (ISP). The computer workstation preferably provides the necessary data processing and storage capabilities and suitably interfaces with telecommunication systems. The present invention allows Officers to contact the present invention via any Internet connection at any time, including during the contacting of a Subject by the present invention. Therefore, the present invention enables Officers to enroll, monitor, and verify at any time (including real-time if desired) a Subject's location and compliance with a Restriction Program.

BRIEF DESCRIPTION OF THE DRAWING FIGURES

DETAILED DESCRIPTION OF THE INVENTION

The present invention generally provides a method and apparatus for monitoring and verifying a Subject's location and/or Compliance with a Restriction Program. While the present invention is described in the context of an Internet based application it is to be appreciated that the present invention may be suitably modified such that any system capable of providing the features and functions of the present invention may be utilized, including, for example, distributed computer networks which utilize telephone links to connect to a centralized database, telephone operated voice prompt systems, and the like.

Figure 1:
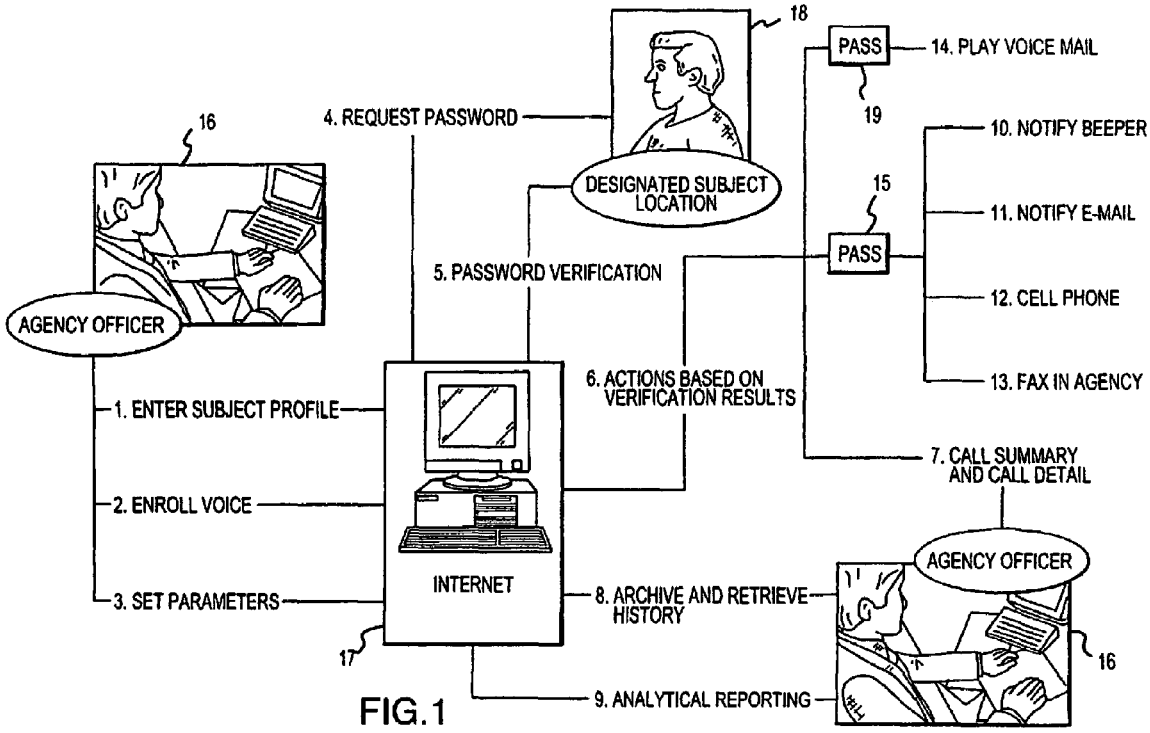
FIG. 1 is a schematic drawing showing the relationship of the Subject, control equipment, and the Officer under a preferred embodiment of the present invention.

Generally, as shown in FIG. 1, the present invention preferably provides for the suitable enrollment, verification, and monitoring of a Subject 18 by an Officer 16 via the Internet 17. The present invention preferably allows an Officer 16, via the Internet 17, to perform the following functions: Enter a Subject's Profile (1); Enroll Voice prints (2); and Set Parameters (3) which determine whether or not a Subject passes or fails a voice verification. Additionally, the present invention preferably utilizes a telephone line to contact a Subject 18 at a designated location and determines whether a Subject is actually the person responding to the automatically generated query by requesting a Password (4) and verifying (5) the authenticity of the Password provided by the person responding to the query. The present invention preferably utilizes publicly available telephony to contact the Subject.

The present invention preferably also takes actions based on verification results (6). These actions may include generating reports, such as playing voice mail 14 messages. The voice mail message may be a unique message (for example, "you may leave the city to go to visit your mom this weekend") or a generic message previously designated by an Officer to be sent to the Subject based upon the Subject's call history. For example, when a Subject has failed a previous contact attempt, a message such as "call your probation officer immediately" may be automatically transmitted to the Subject. Similarly, when a verification fails, a message such as "posing as the Subject is a misdemeanor punishable up to 6 months in jail and $10,000" may be suitably transmitted by the present invention to the recipient of the verification call. However, under a preferred embodiment of the present invention, messages are only transmitted upon a successful verification of the Subject's location.

The present invention also may be configured to contact an Officer when a failed contact and/or a passed contact occurs. The present invention suitably allows the Officer to be contacted by any means available, including, but not limited to, via a "beeper" (10), e-mail messages (11), phone calls (12), and messages to work (13). The present invention preferably allows an Officer the flexibility of determining when, where, how, and under what circumstances the Officer is contacted when successful and/or unsuccessful verifications of a Subject's location and/or compliance with a Restriction Program occur.

The present invention also preferably allows an Officer via the Internet, to access details of recent call summaries (7), retrieve archived calls (8), and review the results of other analytical reporting (9). Thus, the present invention allows an Officer total and complete access to all responses by a Subject and/or a Subject's imposter(s) to queries from the present invention, since the Subject was enrolled into the voice verification monitoring system of the present invention.

Figure 2:
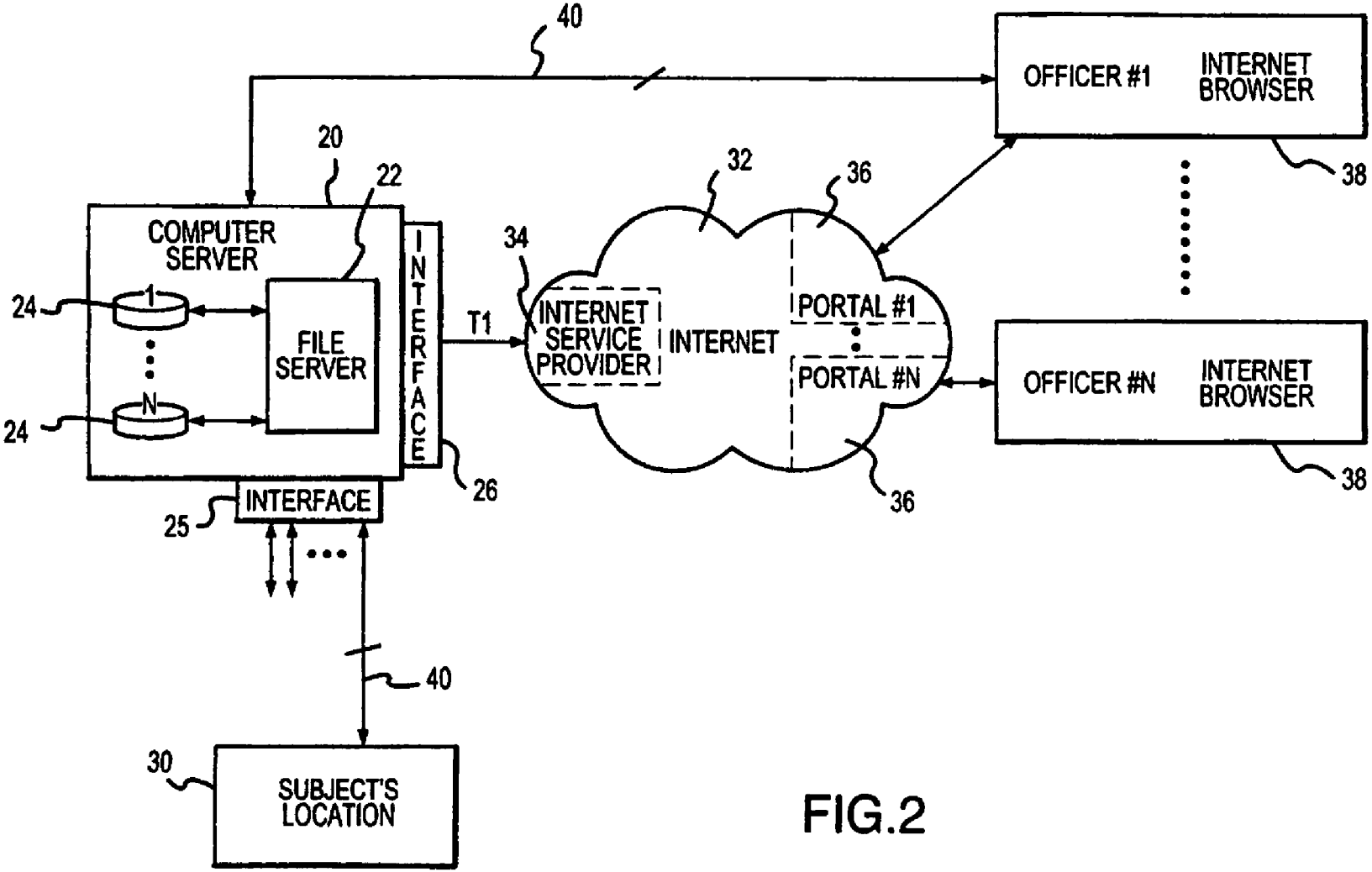
FIG. 2 is a block diagram of a preferred embodiment of the present invention.
Figure 3A:
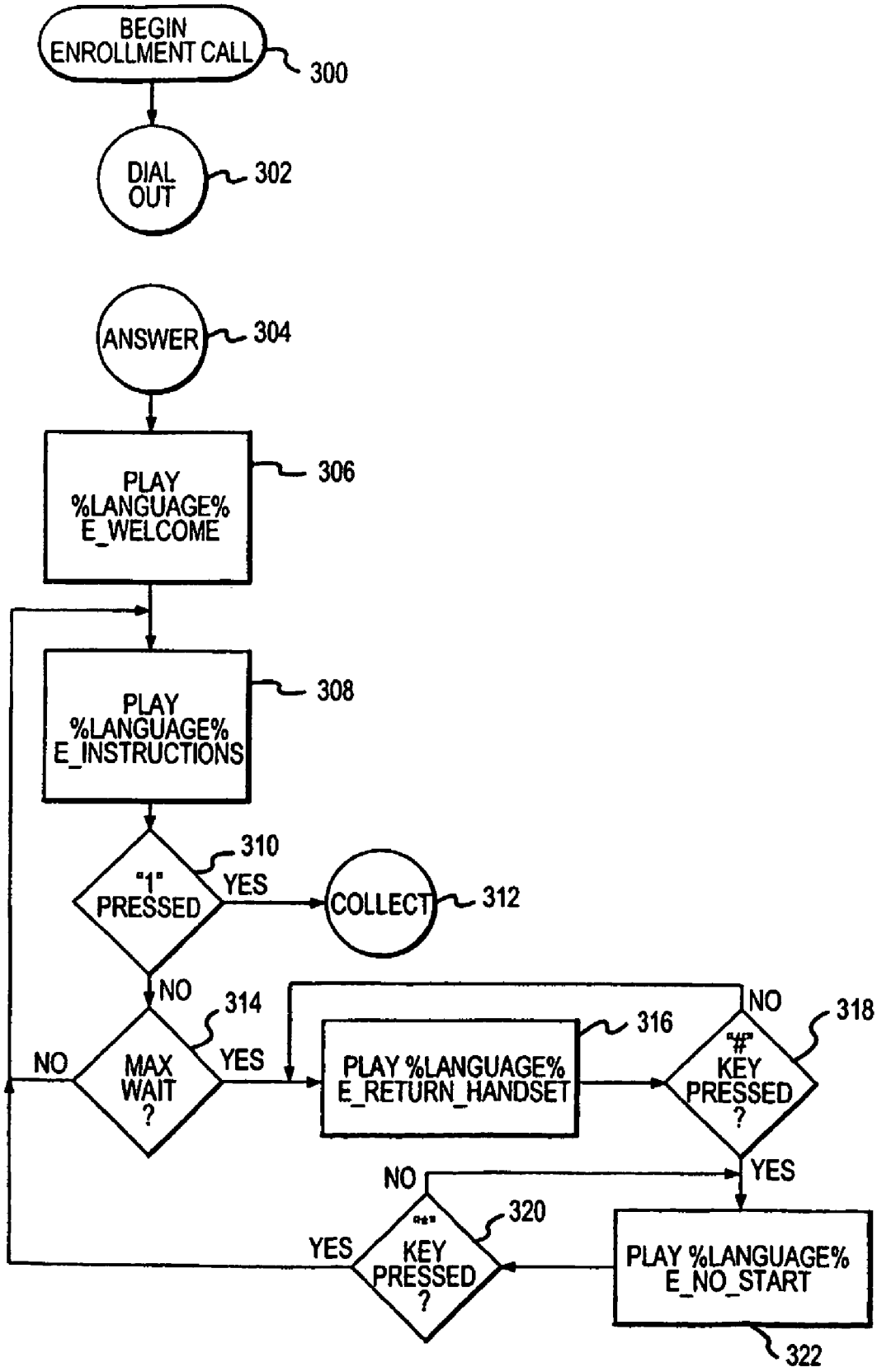
FIG. 3 is a flow diagram of the Subject enrollment process utilized by a preferred embodiment of the present invention.
Figure 3B:
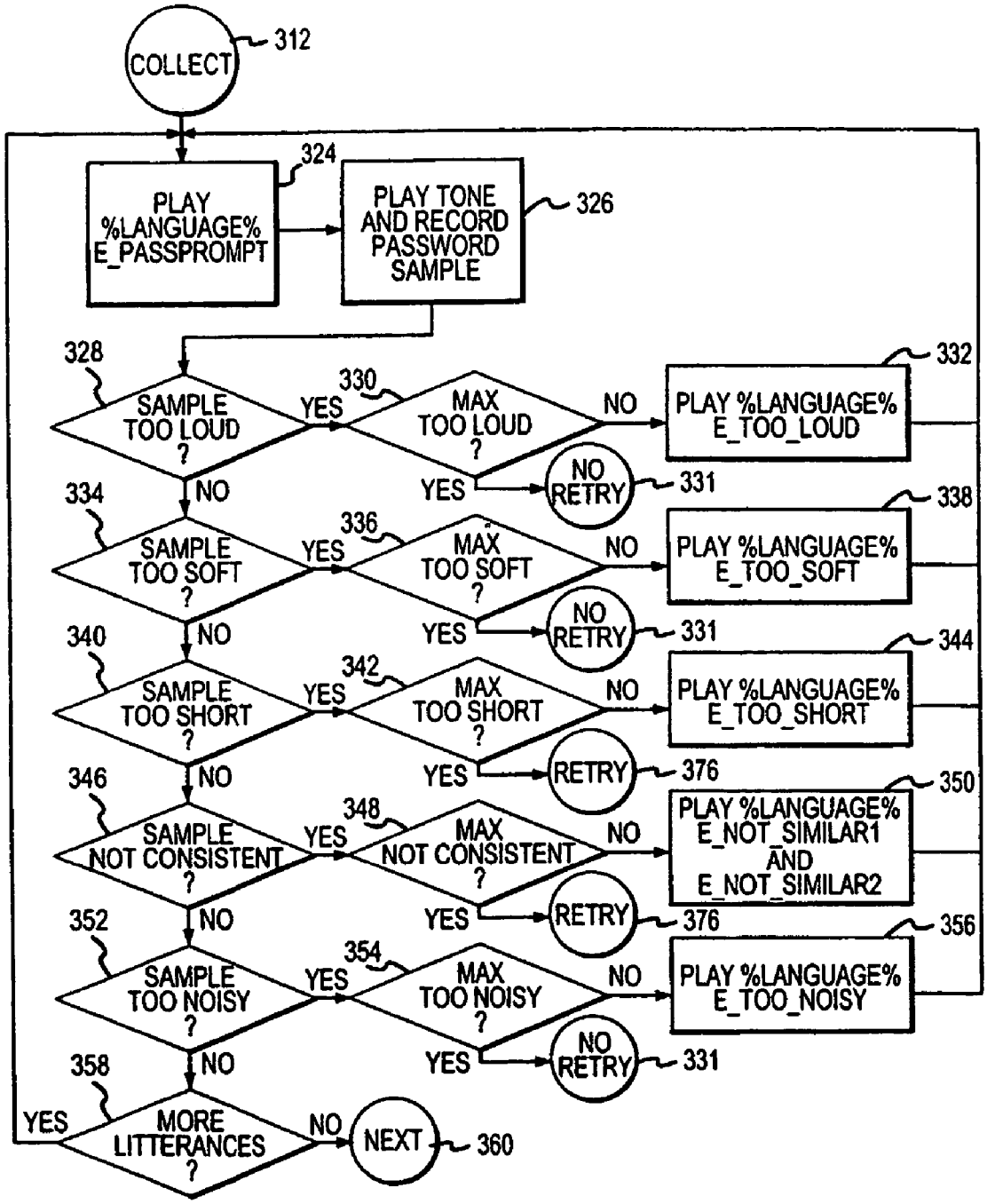
Figure 3C:
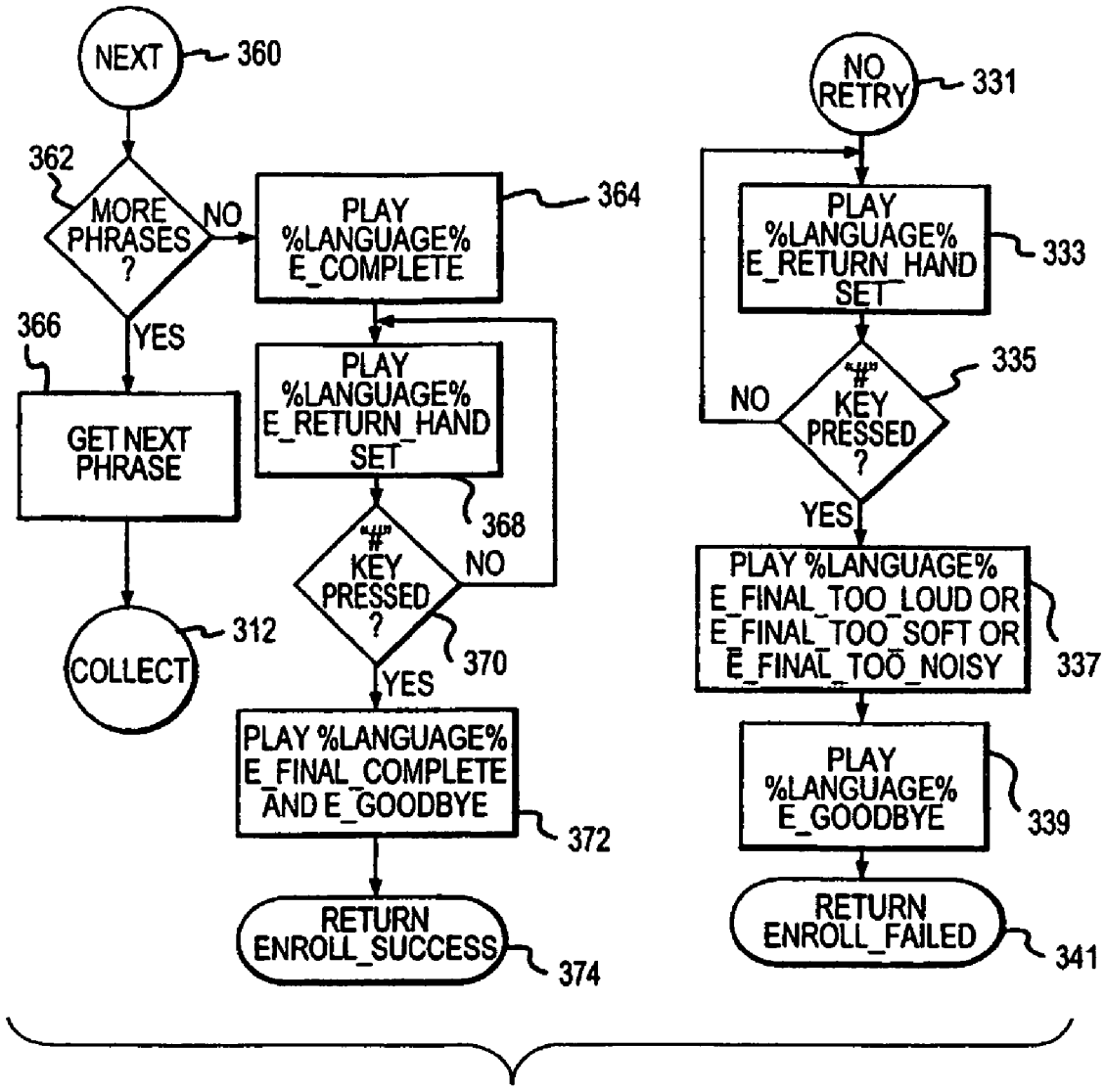
Figure 3D:
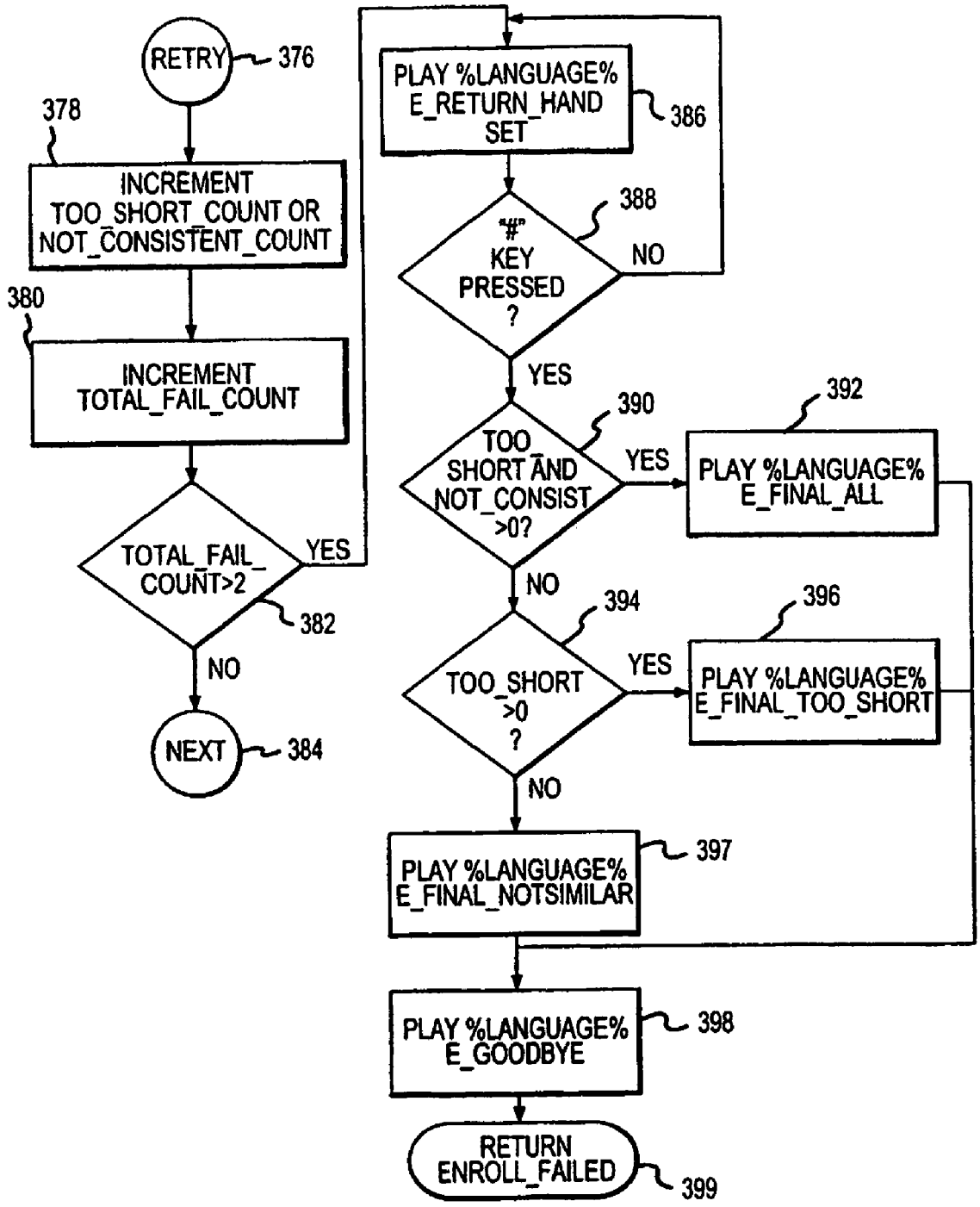
Figure 4A:
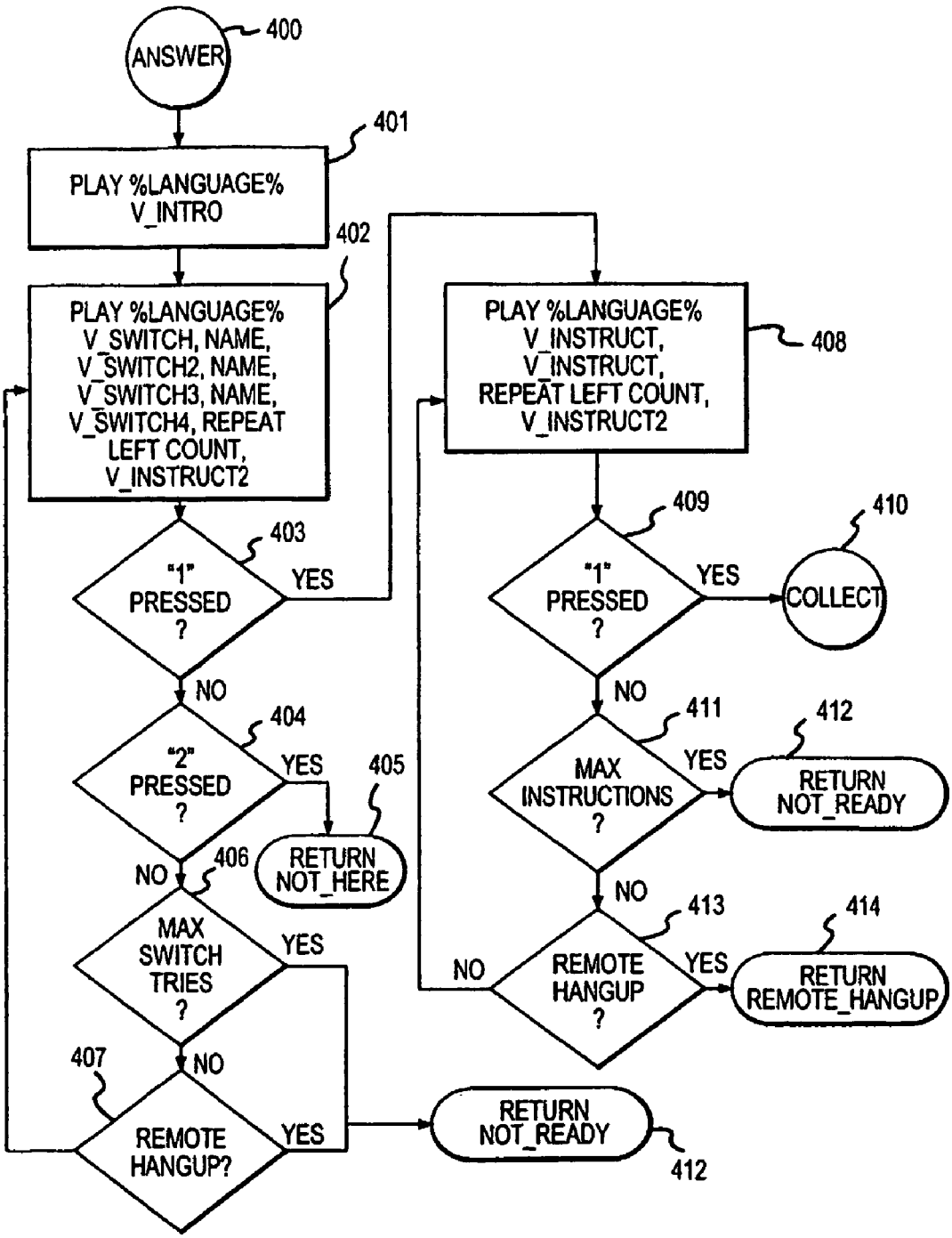
FIG. 4 is a flow diagram of the verification process utilized by a preferred embodiment of the present invention to determine whether a Subject is at a specific location at a specific time.
Figure 4B:
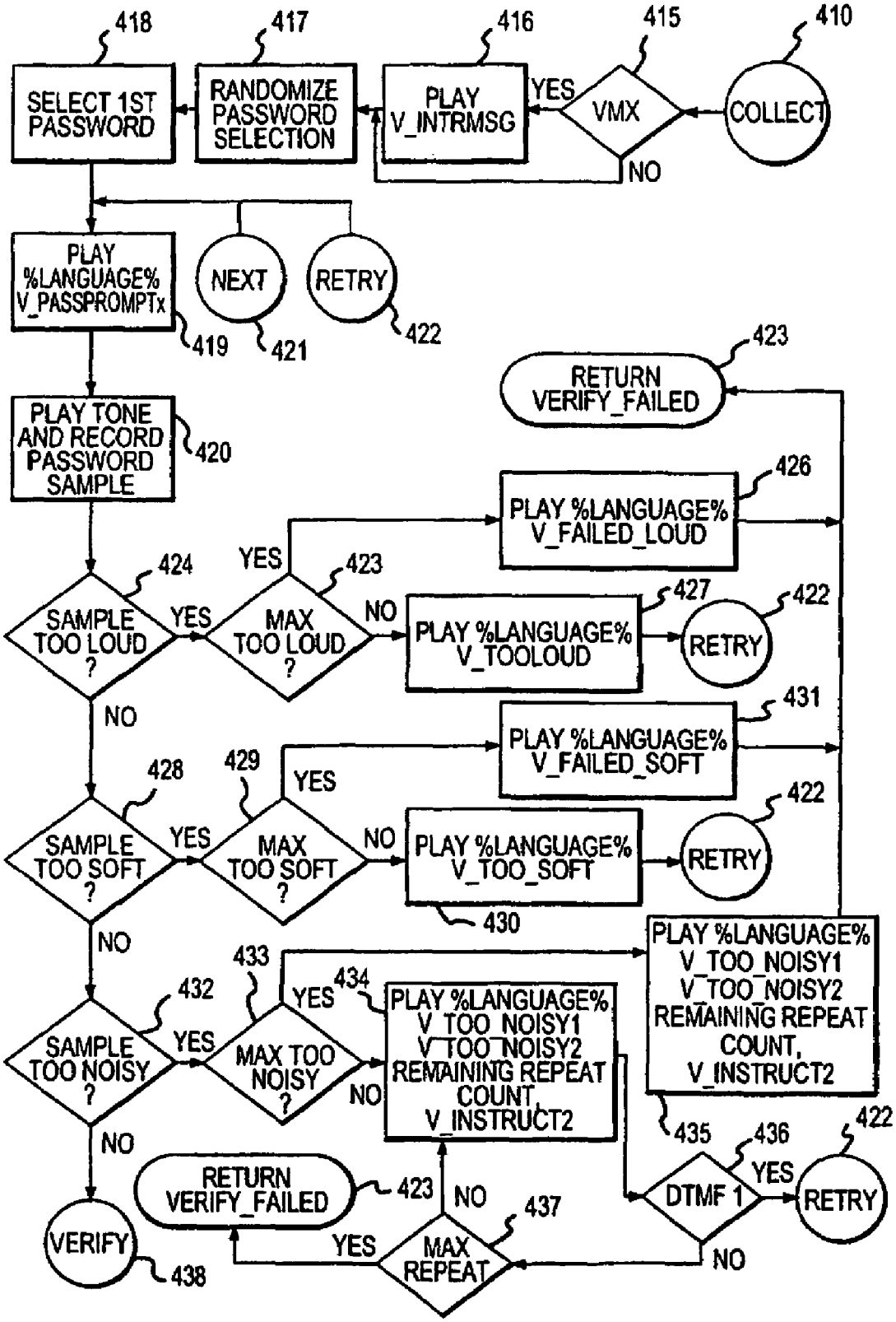
Figure 4C:
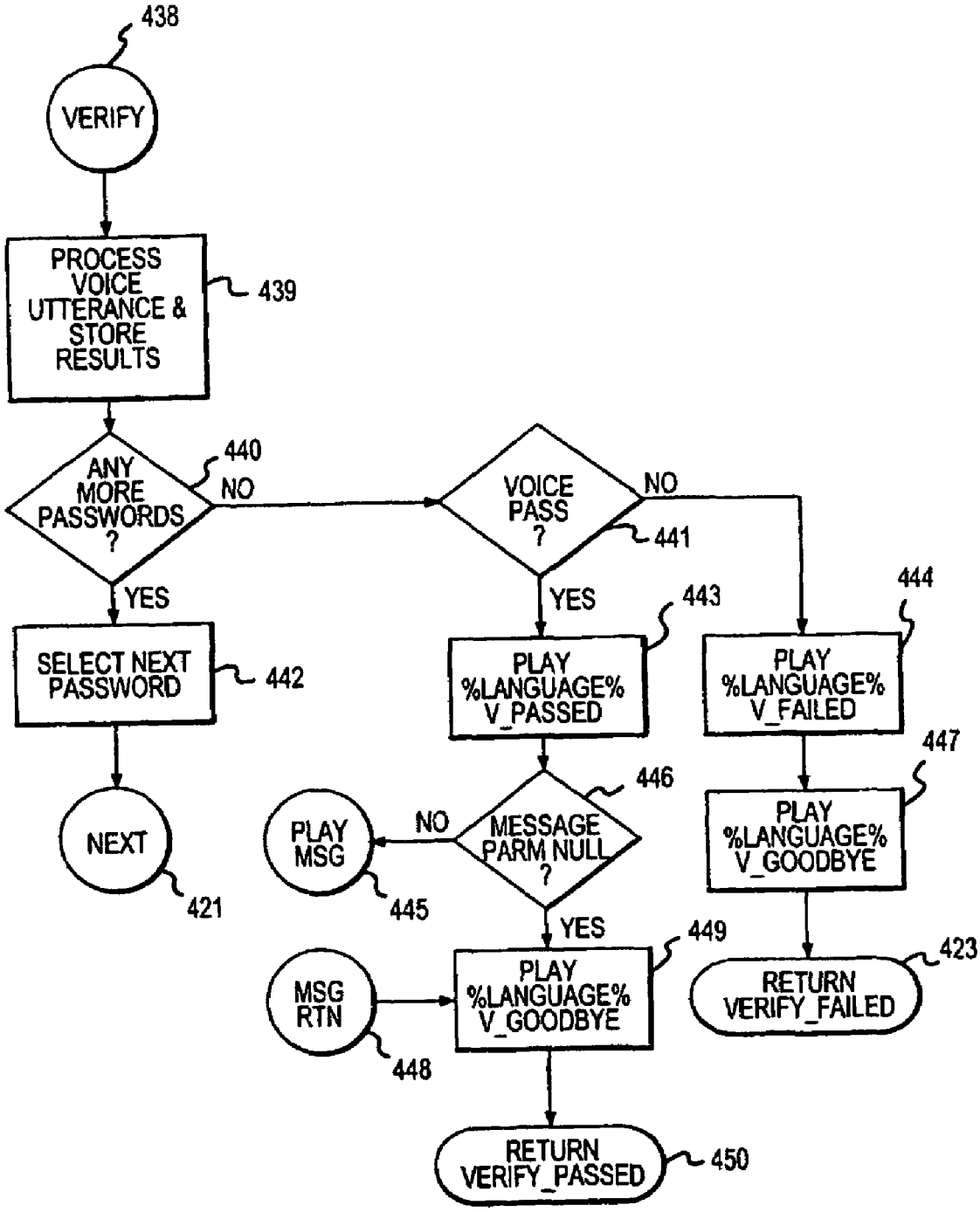
Figure 4D:
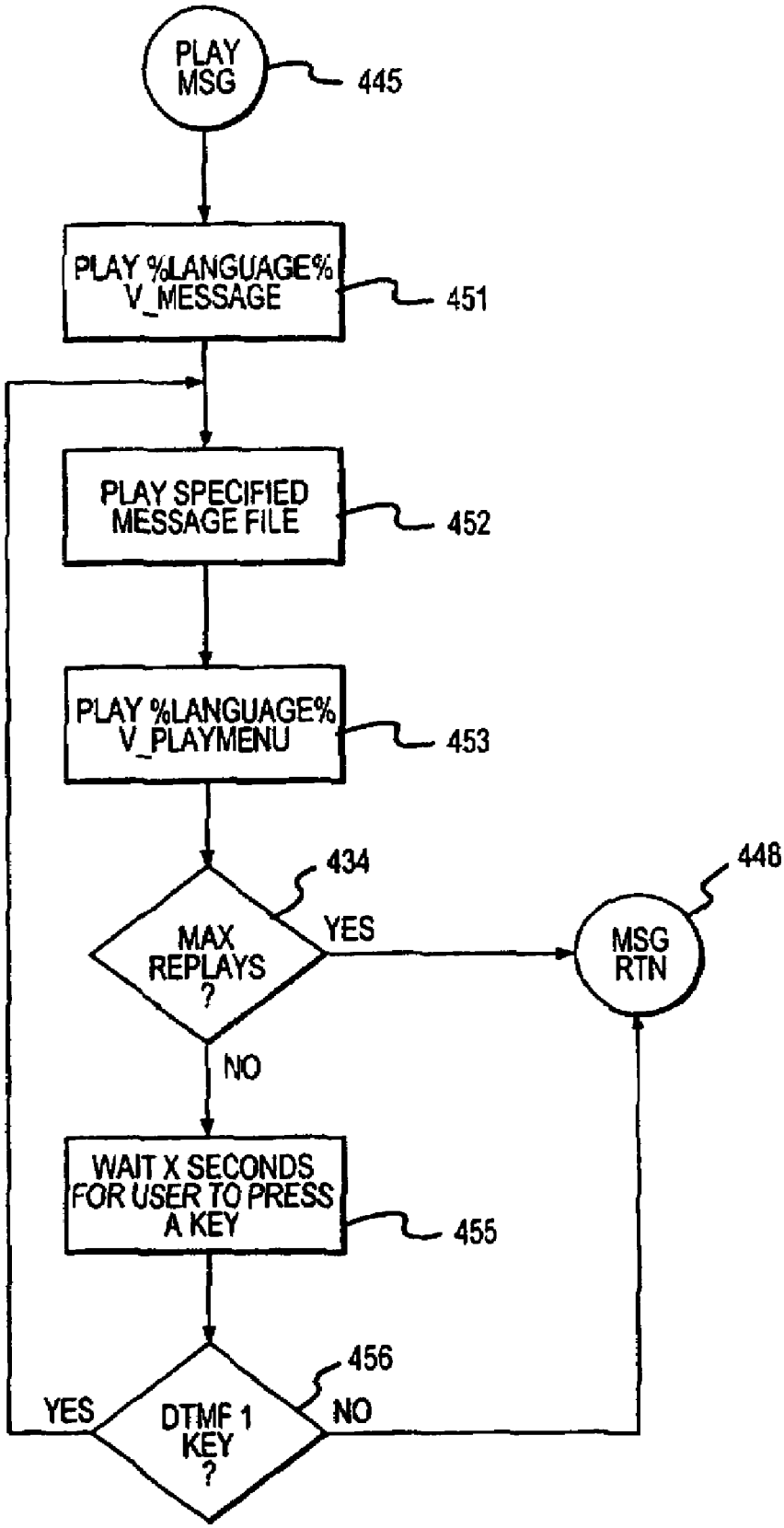

Referring now to FIG. 2, the present invention preferably utilizes a computer server 20 such as a Pentium™ based personal computer, a mini-computer, a main-frame computer or the like to provide the various data manipulation and control features necessary to implement the voice verification system of the present invention. The computer server 20 preferably includes a file server which suitably controls the retrieval and receipt and transmission of data from the Internet 32, the Subject 30, and databases 24. Suitable interfaces (26 and 28) connect the computer server 20 to the Internet 32 and Subject 30. Such interfaces may include modems, T-1 telecommunication links, and the like. The present invention utilizes currently available computer systems and is not directed to the hardware utilized in providing the features and functions of the present invention. In short, any system architecture which facilitates the Internet based voice monitoring verification system of the present invention is considered as being within the scope of the present invention.

In a preferred embodiment, the computer server 20 is suitably connected to an Internet Service Provider ("ISP") (34) which suitably provides connectivity to a web page utilized by others to access the various features of the present invention. However, any method of providing connectivity by a plurality of Officers to the computer server 20, via the Internet or otherwise, is to be considered as being within the scope of the present invention. Security and access to the features of the present invention is suitably controlled via encryption, Passwords, sign-on's, and the like.

Each Officer preferably accesses the features of the present invention by utilizing an Internet Browser 38 suitably connected via an Internet portal 36 to the Internet 32. Any Internet browser 38 may be utilized by an Officer to contact the web page for the present invention. Any device which provides Internet connectivity may be utilized to connect with the computer server 20, such devices include, but are not limited to, digital phones, pagers, Palm® units, and personal computers.

The present invention preferably utilizes voice verification software programs such as the T-NETIX SpeakEZ Voice Print® to verify that the speaker is, in fact, the Subject. However, the present invention is not limited to using the SpeakEZ Voice Print program, any software or hardware which provides accurate verification of a Subject's voice may be suitably utilized in conjunction with the features and functions of the present invention.

The present invention suitably allows an agency, for example the Colorado Department of Corrections, to establish an agency profile. The agency profile preferably contains information pertaining to an agency such as telephone numbers, fax numbers, addresses, contact persons, default actions the agency wishes to be taken if a voice verification fails, how often action will be taken if a failure occurs, the telephone company the agency prefers to use, voice tolerance levels, how much time Subjects have to complete a verification, and the like.

Once an agency is established, information pertaining to the Officers assigned to that agency are preferably entered into the database. This information preferably includes: name; address; contact numbers; preferred language (the language in which the present invention will provide verbal prompts to the Officer); actions which the Officer prefers the present invention to take when verification failures occur; and various other options. The present invention also preferably allows an Officer to obtain the contact numbers for other Officers and or users designated by an agency. Additionally, the present invention suitably controls access of Officers to necessary information while ensuring designated agency officials can obtain reports on all of the various activities being provided by the present invention for the agency. For example, the present invention suitably allows designated officials to access information pertaining to the number of failed and/or passed verifications, how often the verification calls were not answered, how many Subjects are enrolled, and other information which assists an agency in managing its caseload of Subjects.

Since the present invention utilizes voice prints of a Subject to verify the Subject's location and compliance with a Restriction Program, the present invention suitably allows an Officer to select, order, have installed, and uninstalled telephone service in locations where a Subject is to be contacted. Additionally, the present invention allows an Officer to designate additional telephone numbers and/or locations at which a Subject is to be contacted. Thus, the present invention also facilitates the installation and removal of telephone services for Subjects.

The present invention also allows an Officer to enter specific information pertaining to each Subject which is utilized in identifying and verifying the location of a Subject at any time. Such information preferably includes an unique identification number for the Subject. The present invention suitably allows an agency to designate the length of such identification numbers and other data points based upon agency needs. Additionally, data on each Subject is preferably entered by an Officer and stored by the present invention in a unique data file. Such data may include the classification of offense, home address and telephone number, work telephone numbers, phone numbers of relatives, sex, language spoken, whether a phone has been installed by the verification monitoring service provider, to which Officer the Subject is assigned, when monitoring is to begin and end, when monitoring actually started/stopped, which telephone number and how often the system is to contact an Officer when a Subject fails a verification and/or does not answer a verification call, how often a busy line is recalled, and various other data. The present invention may be suitably modified to store and recall any data desired by an Officer without departing from the spirit or scope of the present invention.

The present invention also preferably allows an Officer to place a hold upon monitoring calls. This feature allows an Officer to temporarily suspend voice verification monitoring at various times thereby preventing erroneous call rejections from corrupting the verification record for a Subject. The Officer may also forward Subjects to other Officers for monitoring, as necessary (for example, when on vacation). Additionally, the present invention suitably allows an Officer to relay a single message to all Subjects assigned to the Officer (for example, "I am on vacation until Jun. 20, 2001, please contact Officer Smith").

The present invention also suitably allows an Officer to real-time view the results of verification calls, force verification calls while connected via the Internet to the verification monitoring system, randomly order verification calls, and the like. Thus, the present invention provides an Officer total control of when, how often, and where the location of a Subject is verified while tabulating and allowing an Officer to real-time review a response by a Subject to a verification call.

Once a data record is established for a Subject, the Subject's voice is preferably enrolled into the voice verification monitoring system of the present invention. Preferably, voice enrollment is accomplished by the present system contacting a Subject via conventional telephone systems. Although verifications can be performed via the Internet, cellular systems, and the like, voice enrollment and verifications are preferably accomplished via conventional telecommunications links due to enhanced voice transmission qualities. Thus, the present invention is not limited to only using conventional telephone lines.

The present invention also allows an Officer to record a Subject's name such that when the Subject is called by the present invention, the Subject's name, as recorded by the Officer, will be used to designate the person to whom the verification call is designated. This feature preferably notifies others within a household, workplace, or the like who is to answer the verification call before beginning the verification process.

In order to verify a Subject is actually the person responding to the prompts of a verification call, the present invention preferably compares an actual response to a previously stored voice print. Obtaining a voice print from a Subject is preferably accomplished via the procedure identified in FIG. 3.

The present invention preferably begins enrolling a Subject into the voice verification monitoring system of the present invention by calling the subject at a predetermined telephone number (Blocks 300 and 302). The Subject is preferably enrolled when the Officer is present. Once the call is answered (Block 304) the present invention preferably provides a welcome message in the Subject's preferred language (Block 306). Next, instructions are provided to the Subject (Block 308), these instructions preferably inform the Subject of the process which will be used to obtain a voice print and instructs the Subject to press the "1" button when they are ready to proceed (Block 310). Should the Subject fail to press the "1" button, the system waits a predetermined time and instructs the Subject to return the hand set to the Officer (Block 316). The system then tells the Officer why the Subject failed and queries the Officer as to whether a retest is desired (Blocks 318 and 322). If the Officer requests a retest, by pressing the "*" key (Block 320), the Officer returns the handset to the Subject and the system restarts with Instructions being provided to the Subject (Block 308). If the Subject presses the "1" button, the system begins collecting a voice print (Block 312).

When collecting a voice print, preferably the system presents to the Subject a Password which provides good phonetic characteristics, such as "Dallas Cowboy," "Miami Florida," "Hollywood California," or the like (Block 324). Preferably a tone is then sounded, and the Subject repeats the Password (Block 326) a predetermined number of times. The system then verifies the voice print is not too loud (Block 328), too soft (Block 334), too short (Block 340), that each utterance is consistent (Block 346), that there is not too much background noise (Block 352), and whether more utterances are required (Block 358). If the voice print sample is too loud (Block 328), too soft (Block 334), or too noisy (Block 352) the present invention preferably informs the Subject of such deficiency (Blocks 332, 338, and 356 respectively) and reacquires the utterances unless a predetermined maximum number of attempts have occurred (Blocks 330, 336, and 354 respectively). In such event, the present invention proceeds to a No Retry algorithm (Block 331) and instructs the Officer to Press the "#" key (Block 333). Upon pressing the "#" key (Block 335) the present invention informs the Subject why the voice enrollment failed (Block 337), says goodbye (Block 339), disconnects the call, and returns to the database a message indicating the enrollment failed (Block 341). Similarly, if the voice prints are too short, or previous utterances are not consistent, the present system preferably proceeds through blocks 376 to 399 until either consistent utterances of the correct length are obtained or the call is discontinued.

The present invention also suitably allows numerous Passwords (Blocks 362 and 366) to be enrolled for each Subject upon the successful completion of a previous Password (Block 360). After all Passwords have been successfully enrolled (Block 364) a message is generated informing the Subject that enrollment is complete and saying goodbye (Blocks 368, 370, and 372). The system also preferably returns an enrollment success message (Block 374) to the Officer.

After a Subject has been enrolled, the present invention suitably contacts the Subject per the time windows designated by an Officer responsible for the Subject. The present invention preferably allows an Officer to specifically designate precise time windows during which a Subject's location is to be verified. When such verification time arrives (either according to a pre-set schedule or, if selected, randomly), the present invention verifies the Subject is the person speaking on the phone.

As shown in FIG. 4, the voice verification process begins upon the answering of the telephone call (Block 400). An introduction in the subjects language is preferably played (Block 401) followed by a questioning of whether the Subject is present in various languages and instructing the answerer to press "1" if the Subject is present and "2" if the subject is not present (Block 402). If a "1" is pressed (Block 403) the process proceeds with providing instructions to the answerer (Block 408). If a "2" was pressed, indicating the Subject is not present at the location (Block 404), the system returns a "Not Here" in the Subject's call history files and terminates the call (Block 405). If neither a "1" nor a "2" is pressed the system continues to query whether the Subject is present until the maximum number of tries is exceeded (Block 406) or the answerer hangs up the phone (Block 407) at which point the system returns a "Not Ready" message to the Subject's file (Block 412).

When the Subject is present at the location further instructions are provided informing stating that if the answerer is the Subject, to press "1" (Block 408). When "1" is pressed for a second time (Block 409), the system proceeds with collecting a voice sample (Block 410). Otherwise, the system continues to monitor the phone connection until a "1" is received (Block 409), the maximum number of tries occurs (Block 411), or the phone is hung up (Block 413). In which instance, the system returns an appropriate message (Blocks 412 and 414).

When the Subject has entered a "1" indicating they are present on the phone, the system verifies (Block 415) and plays any voice instruction messages (Block 416). The system then randomly selects and plays a Password (preferably at least four Passwords are available for each Subject) (Blocks 417, 418, and 419) thereby ensuring pre-recorded messages can not be used to trick the system. A tone follows the Password at which instance the Subject repeats the selected Password (block 420). The system then analyzes the Password provided by the Subject to determine whether it is too loud (Block 424), too soft (Block 428), or too noisy (Block 432). If any of these conditions exist, the system informs the Subject of the problem and instructs the Subject to retry the Password until an acceptable Password is provided or the number of retries allowed is exceeded (see Blocks 425-427, Blocks 429-431, and Blocks 433-437). If an acceptable Password is not received in the allotted number of tries, the system records a Verify Failed (Block 423) and terminates the call.

If the Password provided by the Subject is not too loud, too soft, or too noisy, the system verifies the Password (Block 438). In verifying the Password, the system first processes the voice utterances determining whether they fall within predetermined thresholds (Block 439). The present invention preferably adjusts thresholds based upon gender data (thereby reducing the possibility of impersonators, especially for females), time of day, and whether the Subject is a new user of the present invention.

After verifying a Password came from the Subject, the system then verifies whether additional Passwords are requested (Block 440). In determining whether additional Passwords are required, the system preferably considers the quality of the previously provided Password (i.e., did it exceed the threshold by a large or small margin), specific requirements of the Officer for this Subject, and other variables, such as line quality, time of day, and location of call.

After the Subject speaks the last required Password, the system provides an indication to the speaker as to whether a Pass or a Fail will be reported (Blocks 443, and 444, respectively). In a preferred embodiment, if the Subject passes the verification and a voice message has been previously recorded by the Officer for the Subject (Block 446), the voice message is played with instructions following (Blocks 451-453). The Subject may then replay the message, record a response, or the like by utilizing commonly available DTMF tones (via the keypad on the telephone). The system then returns to its previous (pre-message) processing (Block 448), terminates the call (Block 449) and records a Pass (Block 450) in the Subject's data file.

As such the present invention, provides an Internet based voice verification monitoring system which utilizes multiples Passwords, selected randomly from a pre-determined list, to verify a Subject's voice. The present system also preferably compensates for the volume of the Subject's replies, the background noise, line quality, and the Subject's gender. The present invention also preferably allows for verification calls to occur at predetermined times, within call windows of varying size, and at any time designated by an Officer, while allowing an Officer immediate access to real-time or earlier verifications.

The present invention also provides case management features and functions such as attaching notes, transferring Subjects to different Officers, identifying back-up duty Officers, creating reports, and the like which enable the Officer to completely verify, monitor, and record a Subject's compliance with a Restriction Program.

While the present invention has been described as encompassing numerous features, capabilities and configurations it is to be appreciated that the present invention encompasses any and all combinations of these and comparable features and is not to be construed as being limited to any preferred embodiment. Additionally, modifications may be made to the process flow, techniques, equipment used, or any other element, factor, step or the like without departing from the scope of the present invention as expressed in the following claims.

The invention claimed is:

1. A method for monitoring compliance with a restriction program using a voice verification system, comprising:

initiating a telephone call from the voice verification system to a remote telecommunications device that is associated with a called party who is subject to the restriction program;

recording the telephone call to the called party in a memory of the voice verification system;

prompting the called party to provide a first password that is selected at random by the voice verification system from a plurality of passwords uniquely associated with the called party, the plurality of passwords stored in the memory of the voice verification system;

verifying a first response from the called party to determine if the first response is an acceptable match to the first password;

transmitting a unique message to the called party when the first response has been verified, wherein a user other than the called party has recorded the unique message specifically for the called party;

providing the user with real-time data indicating the results of the verifying step; and providing the user with access to previous telephone calls to the called party, the previous telephone calls stored in the memory of the voice verification system.

2. The method of claim 1, wherein the real-time data and the access to previous telephone calls are provided to the user via an Internet connection.

3. The method of claim 1, further comprising:

providing a plurality of timing options to the user, the timing options including initiating the telephone calls at random times, initiating the telephone calls at preselected times, and initiating the telephone calls upon demand by the user.

4. The method of claim 1, further comprising:

prompting the called party to provide a second password that is selected at random from the plurality of passwords when the first response is not an acceptable match to the first password; and verifying a second response from the called party to determine if the second response is an acceptable match to the second password.

5. The method of claim 1, wherein the user is a parole officer and wherein the called party is a paroled individual.

6. The method of claim 1, wherein the user is a probation officer and wherein the called party is an individual on probation.

7. A method for monitoring compliance with a restriction program using a voice verification system, comprising:

initiating a telephone call from the voice verification system to a remote telecommunications device that is associated with a called party who is subject to the restriction program;

recording the telephone call to the called party in a memory of the voice verification system;

prompting the called party to provide a first password that is selected at random by the voice verification system from a plurality of passwords uniquely associated with the called party, the plurality of passwords stored in the memory of the voice verification system;

verifying a first response from the called party to determine if the first response is an acceptable match to the first password;

prompting the called party to provide a second password that is selected at random from the plurality of passwords when the first response is not an acceptable match to the first password; and verifying a second response from the called party to determine if the second response is an acceptable match to the second password; and establishing a telephone call to a user after a second or subsequent failed response from the called party, wherein the user is not in communication with the voice verification system during the verifying steps.

8. The method of claim 7, further comprising:

playing the recorded telephone call to the user.

9. The method of claim 7, further comprising:

connecting the user on the second telephone call to the called party via the voice verification system.

10. The method of claim 7, further comprising:

contacting a law enforcement agent after the second or a subsequent failed response from the called party, wherein the law enforcement agent is contacted using a method other than a telephone call.

* * * * *